US008608344B2

(12) United States Patent
Lan

(10) Patent No.: US 8,608,344 B2
(45) Date of Patent: Dec. 17, 2013

(54) LED LIGHTING STRUCTURE

(75) Inventor: Wen-Ji Lan, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 230 days.

(21) Appl. No.: 13/226,459

(22) Filed: Sep. 6, 2011

(65) Prior Publication Data

US 2013/0058088 A1 Mar. 7, 2013

(51) Int. Cl.

| | |
|---|---|
| ***F21V 31/04*** | (2006.01) |
| ***F21V 3/02*** | (2006.01) |
| ***F21V 15/01*** | (2006.01) |

(52) U.S. Cl.

USPC ..... 362/267; 362/235; 362/240; 362/311.02; 362/362

(58) Field of Classification Search

USPC ..... 362/223, 224, 240, 249.02, 267, 362/311.02, 555, 217.05, 235–237, 362, 362/580

See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 6,520,666 | B1 * | 2/2003 | Beyerlein et al. | 362/471 |
| 7,560,003 | B2 * | 7/2009 | Naughton et al. | 156/91 |
| 7,938,558 | B2 * | 5/2011 | Wilcox et al. | 362/236 |
| 8,007,131 | B2 * | 8/2011 | Liu et al. | 362/267 |
| 8,172,425 | B2 * | 5/2012 | Wen et al. | 362/249.02 |

* cited by examiner

*Primary Examiner* — Alan Cariaso

(57) ABSTRACT

An LED lighting structure includes a main body and a filling body. The main body has a first side and a second side. The first side has multiple raised sections. The second side has multiple light incidence sections corresponding to the raised sections respectively. At least one recessed channel section is formed on the second side around the light incidence sections. The filling body is disposed in the channel section. The filling body provides waterproof effect to prevent humidity and alien particles from infiltrating into the channel section. Also, multiple main bodies can be quickly serially connected.

8 Claims, 8 Drawing Sheets

LED LIGHTING STRUCTURE

BACKGROUND OF THE INVENTION

1. Field of the Invention

The present invention relates generally to an LED lighting structure, and more particularly to an LED lighting structure, which has waterproof effect and can be quickly assembled/disassembled.

2. Description of the Related Art

It is known that the light-emitting element, that is, the halogen lamp, in the existent streetlight has been gradually replaced with light-emitting diode (hereinafter abbreviated as LED) to catch up with the trend toward energy saving and carbon reduction and meet the requirement of environmental protection.

LED has been developed since 1950 and widely applied in various fields.

LED works in the principle of direct conversion of electrical energy into optical energy. III-V family compound semiconductors such as gallium phosphide (GaP) and arsenic phosphide (GaAs) are made from V family elements such as nitrogen (N), phosphorus (P) and arsenic (As) and III family elements such as aluminum (Al), gallium (Ga) and indium (In) by means of liquid phase epitaxy (abbreviated as LPE) or vapor phase epitaxy (abbreviated as VPE). The substrate of LED is made from III-V family compound semiconductors. A voltage is applied to the positive and negative electrodes of the substrate. When current passes through the substrate, the electrons combine with the electron holes to fall into low valence band. The excess energy is released in the form of light to emit light.

The conventional LED lighting includes a substrate and multiple packaged LED bulbs arranged on the substrate. A lens or a lampshade is assembled with the substrate for focusing or reflecting the light emitted from the LED bulbs. It is necessary to mass-produce various molds for manufacturing different sizes of lenses or lampshades to meet different requirements in specification. As a result, the mold development cost is very high.

According to the aforesaid, the conventional LED lighting has the following shortcomings:

1. The cost is higher.
2. The mold cannot be commonly used.

SUMMARY OF THE INVENTION

A primary object of the present invention is to provide an LED lighting structure, which is manufactured at lower cost.

A further object of the present invention is to provide the above LED lighting structure, which has waterproof effect.

A still further object of the present invention is to provide the above LED lighting structure, which can be quickly assembled/disassembled.

To achieve the above and other objects, the LED lighting structure of the present invention includes a main body and a filling body.

The main body has a first side and a second side. The first side has multiple raised sections. The second side has multiple light incidence sections corresponding to the raised sections respectively. At least one recessed channel section is formed on the second side around the light incidence sections.

The filling body is disposed in the channel section.

The filling body provides waterproof effect to prevent humidity and alien particles from infiltrating into the channel section. Also, in manufacturing, multiple main bodies can be quickly serially assembled/disassembled through the filling bodies. Accordingly, the use of the LED lighting structure is more flexible. In addition, the manufacturing cost of the LED lighting structure is greatly lowered and the lifetime of the LED lighting structure is prolonged.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
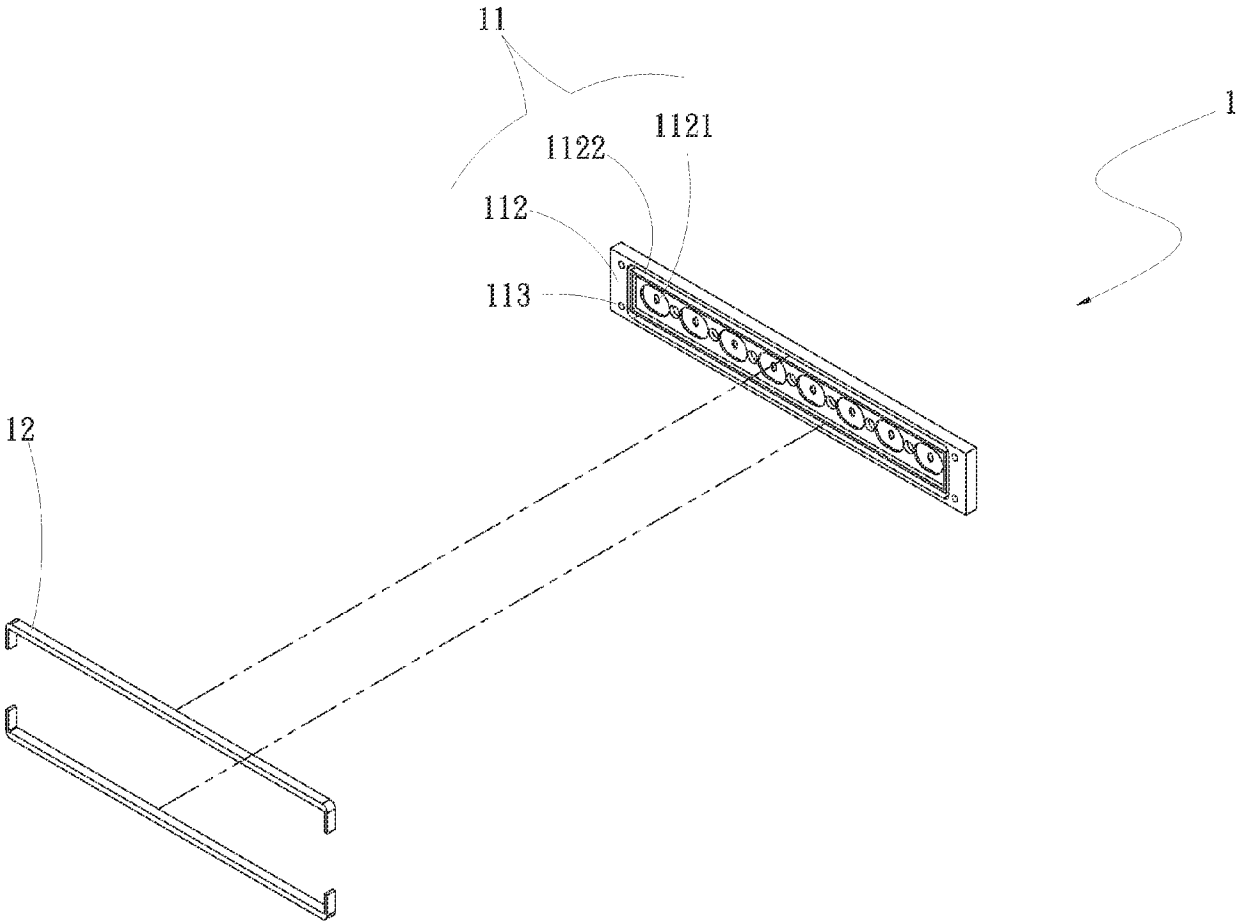
FIG. 1 is a perspective exploded view of a first embodiment of the LED lighting structure of the present invention.
Figure 2:
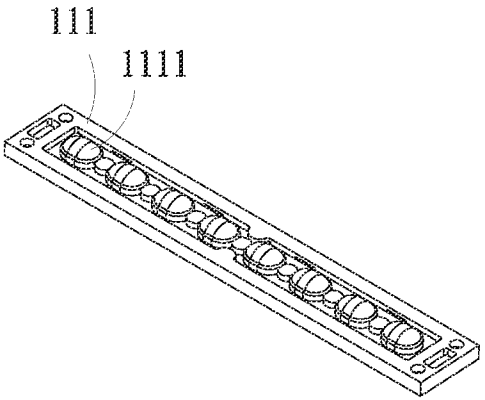
FIG. 2 is a perspective assembled view of the first embodiment of the LED lighting structure of the present invention.

Please refer to FIGS. 1 and 2. FIG. 1 is a perspective exploded view of a first embodiment of the LED lighting structure of the present invention. FIG. 2 is a perspective assembled view of the first embodiment of the LED lighting structure of the present invention. According to the first embodiment, the LED lighting structure 1 includes a main body 11 and a filling body 12.

The main body 11 has a first side 111 and a second side 112. The first side 111 has multiple raised sections 1111. The second side 112 has multiple light incidence sections 1121 corresponding to the raised sections 1111 respectively. At least one recessed channel section 1122 is formed on the second side 112 around the light incidence sections 1121.

The main body 11 further has multiple locating holes 113 passing through the main body 11 between the first and second sides 111, 112.

The filling body 12 is disposed in the channel section 1122. The filling body 12 is C-shaped. The filling body 12 is selected from the group consisting of a silicone strip and a rubber strip. The filling body 12 provides waterproof effect to prevent humidity and alien particles from infiltrating into the channel section 1122 so as to prolong lifetime of the LED lighting structure.

Figure 3:
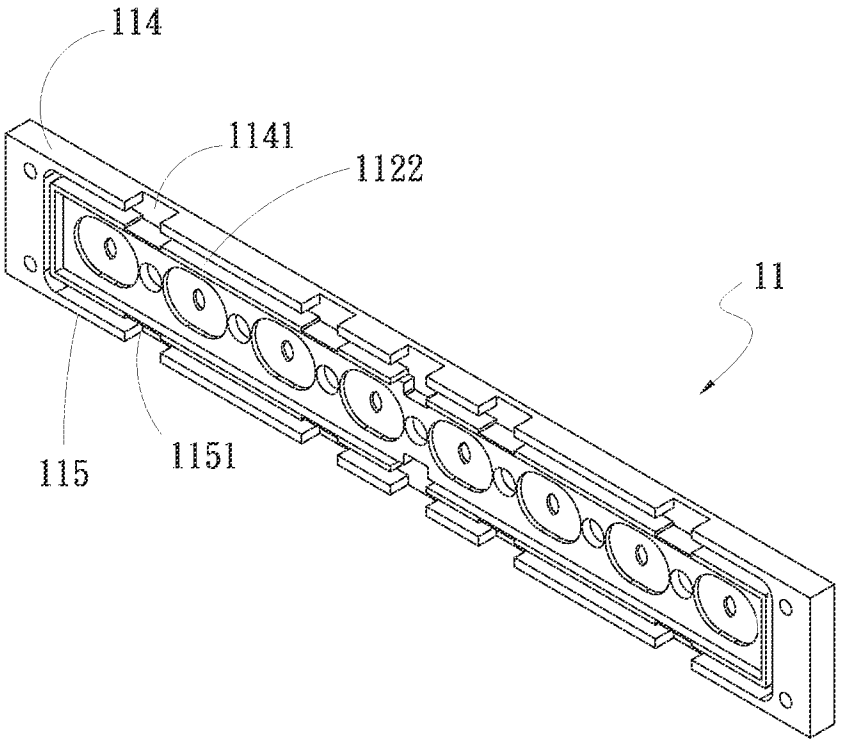
FIG. 3 is a perspective view of a second embodiment of the LED lighting structure of the present invention.

Please refer to FIG. 3. FIG. 3 is a perspective view of a second embodiment of the LED lighting structure of the present invention. The second embodiment is substantially identical to the first embodiment in structure and thus will not be repeatedly described hereinafter. The second embodiment is different from the first embodiment in that the main body 11 further has a third side 114 and a fourth side 115 opposite to the third side 114. The third and fourth sides 114, 115 respectively have a first notch 1141 and a second notch 1151 in communication with the channel section 1122.

Figure 4:
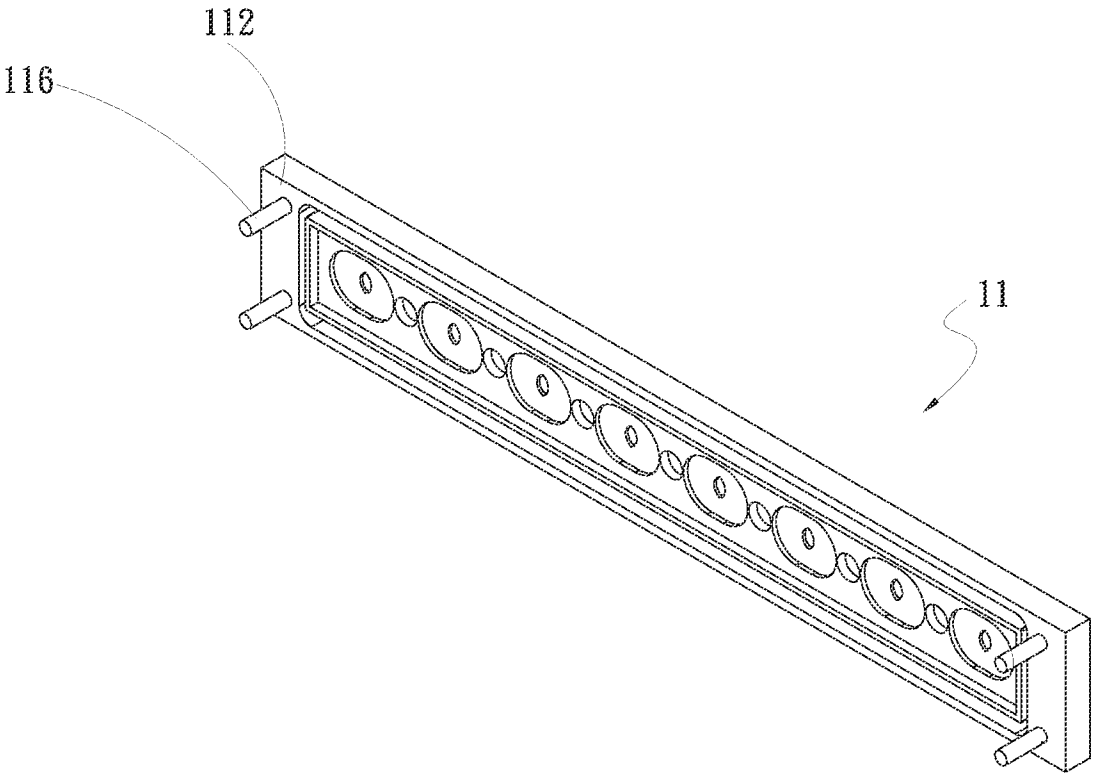
FIG. 4 is a perspective view of a third embodiment of the LED lighting structure of the present invention.

Please refer to FIG. 4. FIG. 4 is a perspective view of a third embodiment of the LED lighting structure of the present invention. The third embodiment is substantially identical to the first embodiment in structure and thus will not be repeatedly described hereinafter. The third embodiment is different from the first embodiment in that the main body 11 further has multiple locating posts 116 extending from the second side 112.

Figure 5:
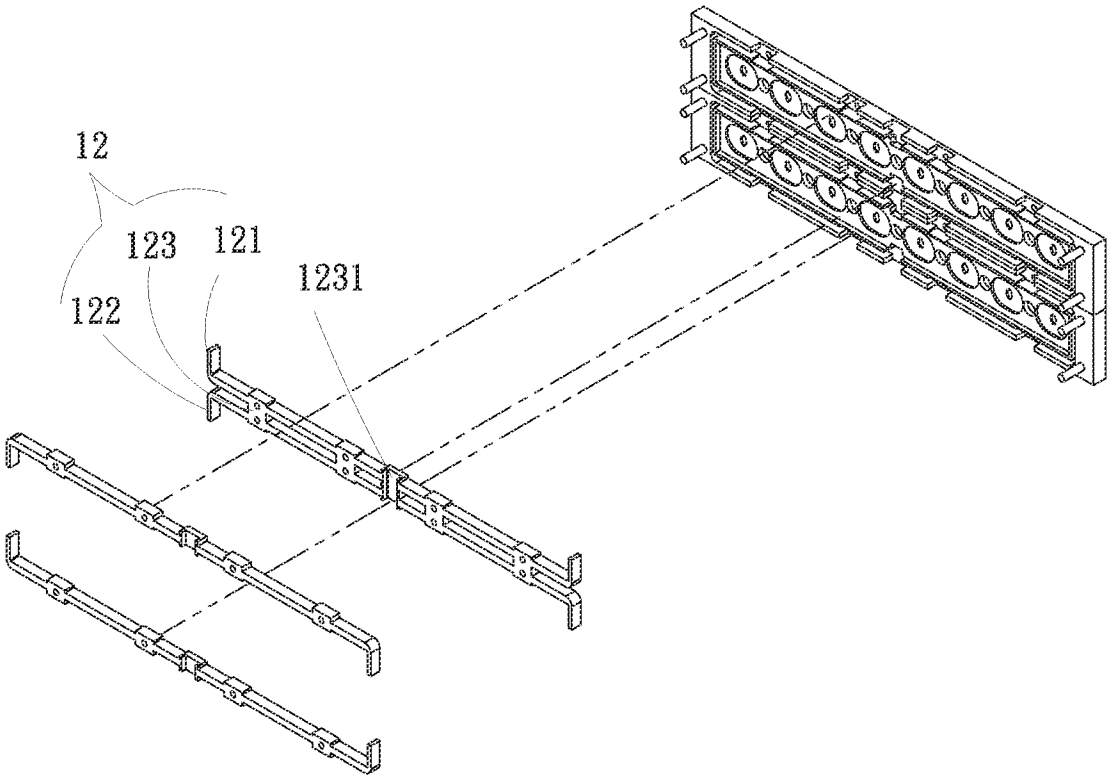
FIG. 5 is a perspective view of a fourth embodiment of the LED lighting structure of the present invention.

Please refer to FIG. 5. FIG. 5 is a perspective view of a fourth embodiment of the LED lighting structure of the present invention. The fourth embodiment is substantially identical to the first embodiment in structure and thus will not be repeatedly described hereinafter. The fourth embodiment is different from the first embodiment in that the filling body 12 has a first section 121, a second section 122 and a connection section 123. The first and second sections 121, 122 are oppositely arranged in a double-C form. The connection section 123 is connected between the first and second sections 121, 122. The connection section 123 has a recess 1231.

Figure 6:
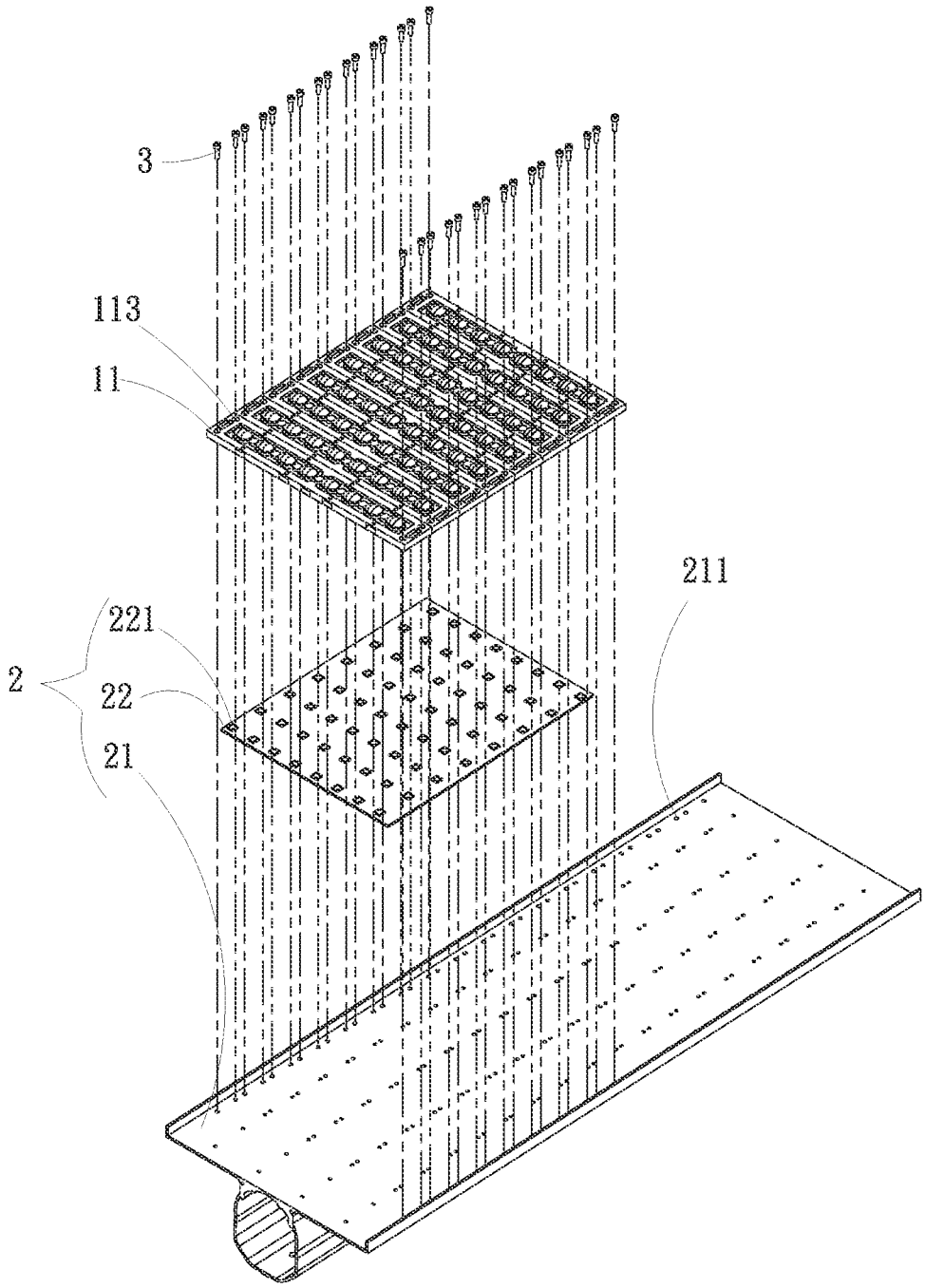
FIG. 6 is a perspective exploded view showing an application of the LED lighting structure of the present invention.
Figure 7:
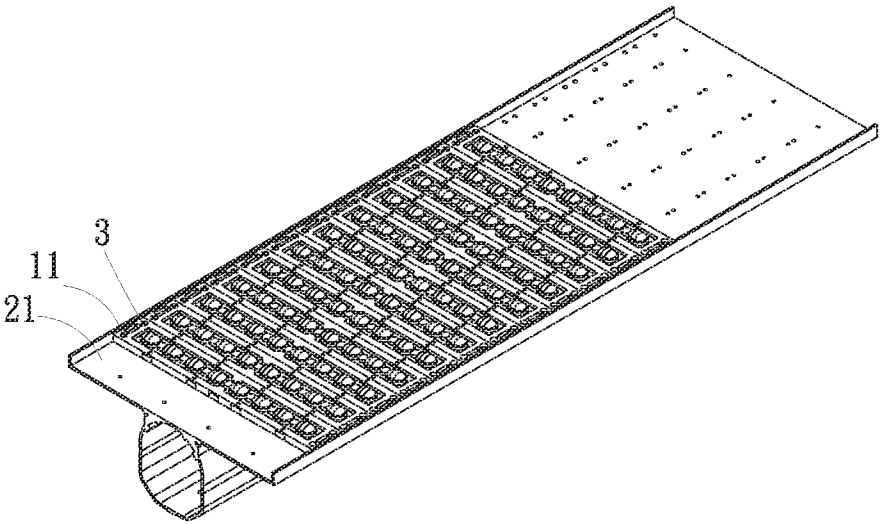
FIG. 7 is a perspective assembled view showing the application of the LED lighting structure of the present invention.
Figure 8:
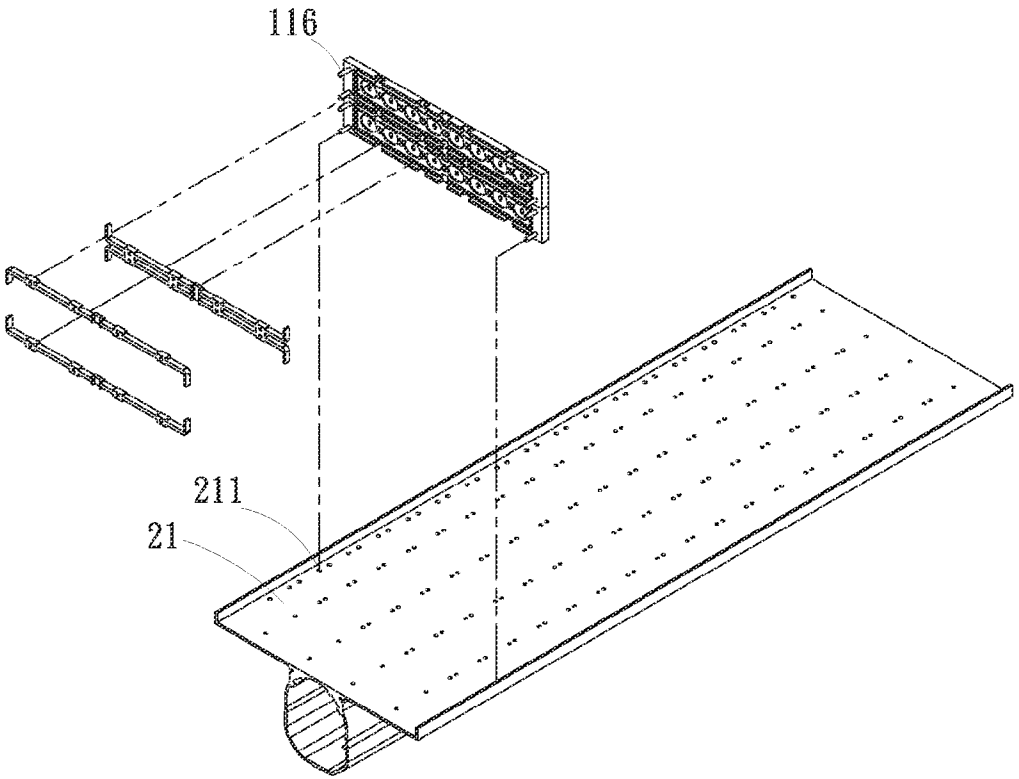
FIG. 8 is a perspective exploded view showing another application of the LED lighting structure of the present invention.

Please refer to FIGS. 6, 7 and 8. FIG. 6 is a perspective exploded view showing an application of the LED lighting structure of the present invention. FIG. 7 is a perspective assembled view showing the application of the LED lighting structure of the present invention. FIG. 8 is a perspective exploded view showing another application of the LED lighting structure of the present invention. Also referring to FIGS. 1 and 4, the main body 11 is assembled with an LED lighting module 2. The LED lighting module 2 includes a base seat 21 and a light-emitting module 22. The light-emitting module 22 includes multiple light-emitting diodes 221. The light-emitting module 22 is attached to one side of the base seat 21. The main body 11 is correspondingly attached to one side of the light-emitting module 22 opposite to the base seat 21. The light-emitting diodes 221 are respectively correspondingly encased in the light incidence sections 1121 of the main body 11.

The main body 11 is assembled with the LED lighting module 2 in such a manner that the base seat 21 is formed with multiple perforations 211 in alignment with the locating holes 113 of the main body 11. At least one fixing member 3 is passed through the locating hole 113 and the perforation 211 to affix the main body 11 to the base seat 21. Alternatively, the base seat 21 is formed with perforations 211 corresponding to the locating posts 116 of the main body 11 of the third embodiment. The locating posts 116 are correspondingly inserted into the perforations 211 to affix the main body 11 to the base seat 21 (as shown in FIG. 8).

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. An LED lighting structure comprising:

a main body having a first side and a second side, the first side having multiple raised sections, the second side having multiple light incidence sections corresponding to the raised sections respectively, at least one recessed channel section being formed on the second side around the light incidence sections;

a filling body disposed in the channel section; and wherein the main body further has a third side and a fourth side opposite to the third side, the third and fourth sides respectively having a first notch and a second notch in communication with the channel section.

2. The LED lighting structure as claimed in claim 1, wherein the filling body is C-shaped.

3. The LED lighting structure as claimed in claim 1, wherein the filling body has a first section, a second section and a connection section, the first and second sections being oppositely arranged in a double-C form, the connection section being connected between the first and second sections.

4. The LED lighting structure as claimed in claim 3, wherein the connection section has a recess.

5. The LED lighting structure as claimed in claim 1, wherein the filling body is selected from the group consisting of a silicone strip and a rubber strip.

6. The LED lighting structure as claimed in claim 1, wherein the main body further has multiple locating holes passing through the main body between the first and second sides.

7. The LED lighting structure as claimed in claim 1, wherein the main body further has multiple locating posts extending from the second side.

8. The LED lighting structure as claimed in claim 1, further comprising an LED lighting module, the LED lighting module including a base seat and a light-emitting module, the light-emitting module including multiple light-emitting diodes, the light-emitting module being attached to one side of the base seat, the main body being correspondingly attached to one side of the light-emitting module opposite to the base seat, the light-emitting diodes being respectively correspondingly encased in the light incidence sections of the main body.

* * * * *